United States Patent [19]

Walker

[11] 4,076,292

[45] Feb. 28, 1978

[54] KEY ACTUATED AUXILIARY DOOR LOCK

[76] Inventor: Brooks Walker, 1280 Columbus Ave., San Francisco, Calif. 94133

[21] Appl. No.: 622,963

[22] Filed: Oct. 16, 1975

Related U.S. Application Data

[63] Continuation-in-part of Ser. No. 563,570, Mar. 31, 1975, Pat. No. 3,971,238, Ser. No. 523,199, Nov. 13, 1974, Pat. No. 3,971,582, and Ser. No. 530,686, Dec. 9, 1974, Pat. No. 3,980,330.

[51] Int. Cl.[2] ..... E05C 17/04

[52] U.S. Cl. ..... 292/262

[58] Field of Search ..... 292/270, 268, 269, 216, 292/198, 262; 70/93

[56] References Cited

U.S. PATENT DOCUMENTS

| | | | |
|---|---|---|---|
| 534,716 | 2/1895 | Hillgendorf | 292/268 |
| 1,497,500 | 6/1924 | Gorovitz | 292/268 X |
| 1,546,182 | 7/1925 | Pohlig | 70/93 |
| 3,432,198 | 3/1969 | Connor | 292/216 |
| 3,433,518 | 3/1969 | Foltz | 292/235 X |
| 3,924,885 | 12/1975 | Markovitch | 292/262 |

*Primary Examiner*—Richard E. Moore
*Attorney, Agent, or Firm*—Gordon Wood

[57] ABSTRACT

A door lock for use with an auxiliary door holding mechanism that is in addition to the conventional door lock. An auxiliary door holding plate is adaptable to be locked and unlocked from outside the door by means of a conventional key-actuated driver bar. The door holding plate may also be locked from inside the door. The door holding plate also permits the door to be held against further opening from a partially open position. In one of the embodiments of the invention a device is employed for swinging the auxiliary locking plate from an unlocked position to a locked position by the closing movement of the door. By another embodiment of the invention the auxiliary locking plate is moved from unlocked position to locked position from outside the door after the latter has been closed.

2 Claims, 5 Drawing Figures

KEY ACTUATED AUXILIARY DOOR LOCK

This application is a continuation-in-part of application Ser. No. 523,199 filed Nov. 13, 1974 now U.S. Pat. No. 3,971,582, issued July 2, 1976; Ser. No. 530,686 filed Dec. 9, 1974 now U.S. Pat. No. 3,980,330, issued Sept. 14, 1976 and application Ser. No. 563,570 filed Mar. 31, 1975 now U.S. Pat. No. 3,971,238, issued July 27, 1976.

This invention relates to a door lock for use with an auxiliary safety door holding member somewhat similar to that disclosed in the two earliest applications noted above.

The main object of the present invention is the provision of means for locking and unlocking a safety door holding member which is employed to obtain added security over conventional door locks. The means employed in the present invention for locking and unlocking the auxiliary door holding member is somewhat similar to that disclosed in the above mentioned application Ser. No 563,570.

Another object of the present invention is the provision of means for actuating an auxiliary door locking member so that the latter may be moved between unlocked and locked positions and vice versa from outside the door as well as from inside the door.

Other objects and advantages will be apparent from the following specification and from the drawings.

Figures 1, 2, 3, 4, 5:
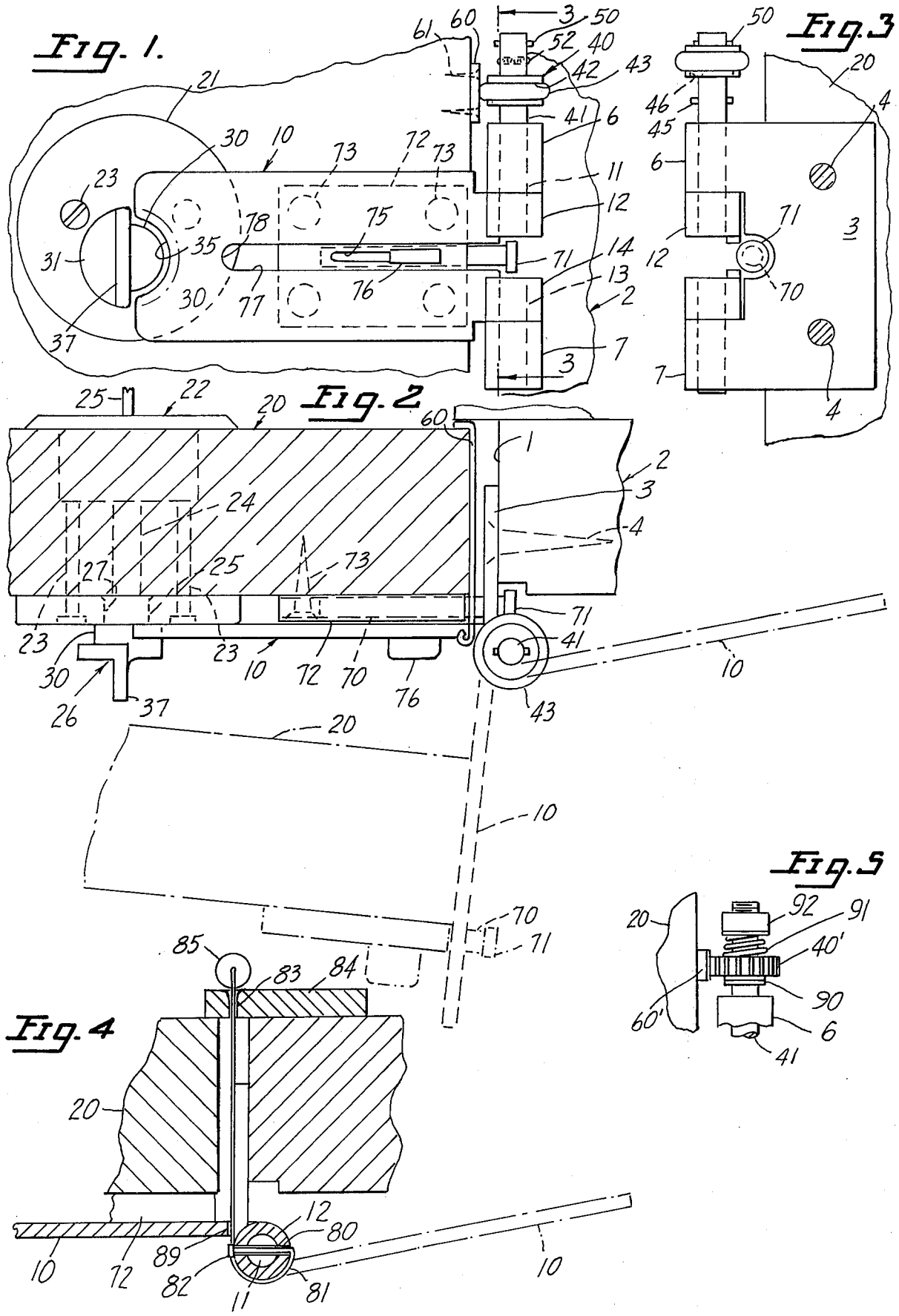
FIG. 1 is a fragmentary side elevation of the inside of a door and its frame showing one embodiment of the invention.
FIG. 2 is a horizontal cross section through the door of FIG. 1 showing the locking mechanism in plan view.
FIG. 3 is a vertical section taken in a plane indicated by lines 3—3 in FIG. 1.
FIG. 4 is a view similar to FIG. 2 showing a modified form of the means for actuating the locking plate.
FIG. 5 is a fragmentary view of the upper end of the hinge pin showing another form of the invention.

The mechanism of the present invention is mounted on the inner face 1 of door frame generally designated 2 (FIG. 2). The mounting means comprises a hinge plate 3 which is secured to frame 2 by means of screws 4 (FIG. 3) and is formed with upper and lower hinge knuckles 6, 7 on which the locking plate generallly designated 10 is swingably supported. This support is achieved by means of a hinge pin 11 which is fixedly secured within upper hinge knuckle 12 on locking plate 10 and a similar hinge pin 13 which is fixedly secured within lower knuckle 14 on plate 10. In this manner the knuckle 12 is rotatably mounted relative to fixed knuckle 6 and hinge knuckle 14 is rotatably mounted relative to knuckle 7.

At this point it will be apparent from the above described structure that the locking plate 10 may be swung from an inoperative position against frame 2 indicated by dot-dash lines in FIG. 2, to an operative position shown in full lines in FIGS. 1 and 2 at which it is parallel to but spaced from door 20.

When in the door holding position of FIGS. 1, 2, the locking plate 10 is adapted to engage, at its free end, a base 21 which cooperates with a conventional door lock generally designated 22 and which is fixedly secured to base 21 by means of through bolts 23 in a conventional manner (FIG. 2). The conventional door lock 22 includes the usual driver bar 24 which is adapted to be rotated by means of a key, a portion of which is indicated at 25. The driver bar 24 cooperates with a boss 25 of a catch generally designated 26. This catch 26 is rotatably supported on base 21 by means of said boss 25 which is rotatably supported within a complementarily formed bore 27 in base 21.

The catch 26 is shown in its unlocked position in FIGS. 1, 2 and said catch includes a cylindrical portion 30 and an integral semicircular portion 31 which is substantially larger in diameter than cylindrical portion 30.

The free end of locking plate 10 is formed with a semicircular recess 35 slightly larger in radius than the radius of cylindrical portion 30. It will be apparent from FIGS. 1 and 2 that when catch 26 is rotated 180° so that enlarged portion 31 registers with the outer end of locking plate 10, the latter is then held in a locked position preventing opening movement of the door 20.

For the purpose of moving the catch 26 between unlocked and locked positions, an axially extending flange 37 is provided to facilitate manual rotation. When the door is closed and locking plate 10 is against base 21 the catch 26 may be moved to its locking position from outside the door by turning key 25. In this connection the particular details of the interaction between driver bar 24 and the catch 26 are not described herein in detail since a suitable structure for effecting movement of the catch 26 is fully disclosed in copending application Ser. No. 563,570.

By the present invention means is provided for swinging the locking plate 10 from the inoperative position shown in dot-dash lines in FIG. 2 to the above described operative position adjacent catch 26. One means for so swinging locking plate 10 is shown in FIGS. 1–3 and includes a wheel 40 mounted on the upper end 41 of pin 11 which, as noted above, is fixedly secured to hinge knuckle 12 of locking plate 10. This wheel 40 is formed with a peripherally extending groove 42 in which is received an O-ring 43 or friction element. The hinge pin 41 is provided with a relatively small cross pin 45 extending diametrally therethrough and which pin 45 cooperates at its ends with downwardly opening recesses 46 formed on wheel 40. By moving the wheel 40 downwardly so as to engage the cross pin 45 the wheel is effectively fixed relative to the hinge pin 41 so that rotation of said wheel results in rotation of the locking plate 10.

In order to disengage the wheel 40 from the hinge pin 41 and make said wheel rotatably on said pin, the wheel may be moved to an upper position against a stop 50 in hinge pin 41 in which upper position it may be effectively held in place by means of spring urged balls 52 on hinge pin 41.

Adapted to cooperate with wheel 40 is a relatively thin friction plate 60 secured to the latch edge of door 20 by means of screws 61. By properly positioning the friction plate 60 relative to the periphery of O-ring 43, it will be apparent that closing movement of the door 20 causes friction plate 60 to engage the periphery wheel 40 thereby rotating said wheel 40 and pin 41 in a clockwise direction as seen in FIG. 2 thereby causing the locking plate 10 to swing from its inoperative position to its operative position. In this manner when the wheel has been moved to its lower clutched position the closing movement of the door swings the locking plate 10 to the position shown in full lines in FIG. 1–2 and in which position the key 25 may be employed to rotate the catch 26 to its locked position as above described. When it is desired to open the door from outside, the key 25 may be turned to move the catch 26 to its unlocked position thereby permitting the locking plate 10 to be swung to its inoperative position by opening movement of the door.

From the above described structure it will be seen that both the wheel 40 and the locking plate 10 may be moved to their inoperative positions when the auxiliary door holding means is not desired.

The length of friction plate 60 should be substantially more than half the outer circumference of O-ring 43 so that engagement of plate 10 with base 21 is ensured. Slippage between the friction plate 60 and O-ring 43 will of course take place.

An additional feature of the invention permits the locking plate 10 to be employed so that the door may be moved to a partially opened position as indicated by dot-dash lines in FIG. 2 and at the same time hold the door against further opening movement by an intruder.

This last mentioned function is accomplished by means of an elongated pin 70 having an enlarged head 71 at one end. Pin 70 is slidably supported within a block 72 secured to the inner face of the door by means of screws 73.

The outer face of the block 72 is formed with an elongated slot 75 (FIG. 1) and a handle 76 extends through said slot and is secured to the pin 70. As best seen in FIG. 2 the handle 76 is long enough to extend through an elongated slot 77 in locking plate 10 and which slot 77 opens outwardly of the inner end of said plate 10. In FIGS. 1 and 2 the pin 70 is shown in a projected position whereby the pin is adapted to be received along the length of slot 77 in locking plate 10 when the latter is swung to the dotted line position of FIG. 2. In this latter position the door may be swung to the partially opened position indicated with the pin 70 in abutment with the inner end 78 of slot 77. When it is desired not to use the holding means for the partially opened door, the pin 70 may be retracted by moving the handle 76 to the left as seen in FIGS. 1 and 2 so that the head 71 of pin 70 is adjacent the latch edge of the door in which position it cannot enter the slot 77.

Another means for swinging the locking plate 10 from its inoperative position to the operative position is shown in FIG. 4 which is a horizontal section through the knuckle 12 in the structure of FIG. 1. In this case a bore 80 is formed diametrally through the knuckle 12 and the hinge pin 11 to permit passing therethrough a cable 81 which is provided at one end with a fitting 82 for securing one end of the cable to the knuckle 12. The cable 81 is then passed through a suitable aperture 89 in locking plate 10 and then through a hole 83 formed in door stop 84. A fitting 85 may be provided on the outer end of cable 81 to permit pulling said cable to swing the locking plate from the dot-dash position of FIG. 4 to the full line position so that it may be locked by key 25.

Another means for swinging the locking plate 10 is shown in FIG. 5. In this case a gear 40' is mounted on pin 41 and a rack 60' is secured to door 20 so as to be in mesh with gear 40'. In order to permit the necessary slippage to occur between rack 60' and the locking plate 10, a friction clutch generally designated 90 is provided. Said clutch may include a torque adjusting spring 91 and a manually manipulatable nut 92 threadedly secured to pin 41. When it is desired to maintain the locking plate 10 in its inoperative position of FIG. 2 it is merely necessary to turn nut 92 to release the compression of spring 91.

I claim:

1. In a door structure that includes a frame, and a door having a hinge edge and an opposite latch edge, a safety lock for holding said door against opening comprising:

an elongated door holding member swingably supported on said frame adjacent said latch edge of the door and adapted to be swung from an inoperative position adjacent said frame to an operative position alongside the inner face of said door, a catch mounted on said door and adapted to be moved from an unlocked position to a locked position for holding said door holding member relative to said door to prevent opening movement of said door, a wheel rotatably mounted relative to said frame and connected to said member, and driving means on said door engageable with said wheel for rotating the latter during the closing movement of said door for swinging said member to operative position.

2. A safety lock according to claim 1 wherein said wheel is provided with gear teeth and said door is provided with a rack for engaging said teeth.

* * * * *